US007487657B2

(12) United States Patent
Steffens

(10) Patent No.: US 7,487,657 B2
(45) Date of Patent: Feb. 10, 2009

(54) DEEP ROLLING HEAD OF A DEEP ROLLING TOOL FOR THE DEEP ROLLING OF CRANKSHAFTS

(75) Inventor: Hans-Toni Steffens, Erkelenz (DE)

(73) Assignee: Hegenscheidt-MFD GmbH & Co. KG (DE)

( * ) Notice: Subject to any disclaimer, the term of this patent is extended or adjusted under 35 U.S.C. 154(b) by 63 days.

(21) Appl. No.: 11/703,257

(22) Filed: Jan. 19, 2007

(65) Prior Publication Data

US 2008/0173055 A1 Jul. 24, 2008

(51) Int. Cl.
*B21D 15/00* (2006.01)

(52) U.S. Cl. ..... 72/110; 72/101

(58) Field of Classification Search ..... 72/101, 72/107, 110, 481.1, 482.91, 482.92; 29/6.01
See application file for complete search history.

(56) References Cited

U.S. PATENT DOCUMENTS

| | | | | |
|---|---|---|---|---|
| 4,445,352 | A * | 5/1984 | Pols | 72/101 |
| 4,575,289 | A * | 3/1986 | Fischer et al. | 409/33 |
| 5,001,917 | A * | 3/1991 | Berstein | 72/110 |
| 6,393,886 | B1 * | 5/2002 | Bagusche | 72/110 |
| 7,021,100 | B2 * | 4/2006 | Heimann | 72/110 |
| 2005/0107230 | A1 * | 5/2005 | Ostertag et al. | 492/1 |

* cited by examiner

*Primary Examiner*—Edward Tolan
(74) *Attorney, Agent, or Firm*—Harness, Dickey & Pierce, P.L.C.

(57) ABSTRACT

The invention concerns a deep rolling head (2) of a deep rolling tool of a shears-type deep rolling unit of a deep rolling machine used for the deep rolling of radii or fillets (5, 6) on the bearing pins (9) of crankshafts (7) with the aid of deep rollers (4) that are rotatably supported in the deep rolling head (2) with appropriate clearance, whereby the deep rolling head (2) is mounted at the outer end of one of the two shears arms (1) of the deep rolling unit. The deep rolling head (2) is pivotably attached to the end (1) of the shears arm.

4 Claims, 2 Drawing Sheets

DEEP ROLLING HEAD OF A DEEP ROLLING TOOL FOR THE DEEP ROLLING OF CRANKSHAFTS

CROSS-REFERENCE TO RELATED APPLICATION

This application claims the benefit of German Application No. 10 2007 003 772.6, filed Jan. 19, 2007. The disclosure of the above application is incorporated herein by reference.

FIELD

The invention refers to a deep rolling head of a deep rolling tool of a shears-type deep rolling unit of a deep rolling machine used for the deep rolling of radii or fillets on the bearing pins of crankshafts with the aid of deep rollers rotatably supported in the deep rolling head with appropriate clearance, whereby the deep rolling head is mounted on the outer end of one of the two shears arms of the deep rolling unit.

BACKGROUND

A relevant status of the art is not known to the applicant.

It is a problem of the invention to attach the deep rolling head to the outer end of the shears arm of a deep rolling unit in such a way that it is able to compensate for the varying stresses that occur in the deep rolling head during the deep rolling of the crankshaft, without transferring these stresses into the deep rolling unit and from the deep rolling unit into the deep rolling machine.

To resolve the problem, it has been suggested that the deep rolling head be pivotably attached to one of the two shears arms of the deep rolling unit.

With the pivotable attachment, the deep rolling head is enabled to compensate for differences in dimension that may exist on the fillets or radii of the bearing pins of crankshafts or also for differences that may arise in the strength of the material in the area of the crankshaft that has to be rolled. Simply spoken, the deep rolling head is enabled to compensate for varying loads that affect the deep rolling tool during the deep rolling operation by swiveling laterally, without transmitting these stresses to the deep rolling unit. As a result, improved product quality may thus be achieved.

SUMMARY

In a preferred first embodiment, the deep rolling head may pivot upon an axis that runs at a given distance from and orthogonal to the axis of rotation of the crankshaft. For this purpose, projecting members are provided on the housing of the deep rolling head, on either of the two front end faces that lie opposite each other and are adjacent to the bottom surface and to the upper surface respectively, which members are pivoted on the outer end of the shears arm of the deep rolling unit.

A relatively simple and reliable design of the attachment of the deep rolling head to the shears arm was found in the form of an F-shaped bracket that can be clamped to the shears arm and has two free legs on which the housing of the deep rolling head can pivot. To stabilize the deep rolling head, a rest is additionally provided that acts between the F-shaped bracket and the upper end face of the housing of the deep rolling head.

The invention will now be described in greater detail with reference to one embodiment thereof.

DRAWINGS

Figure 1:
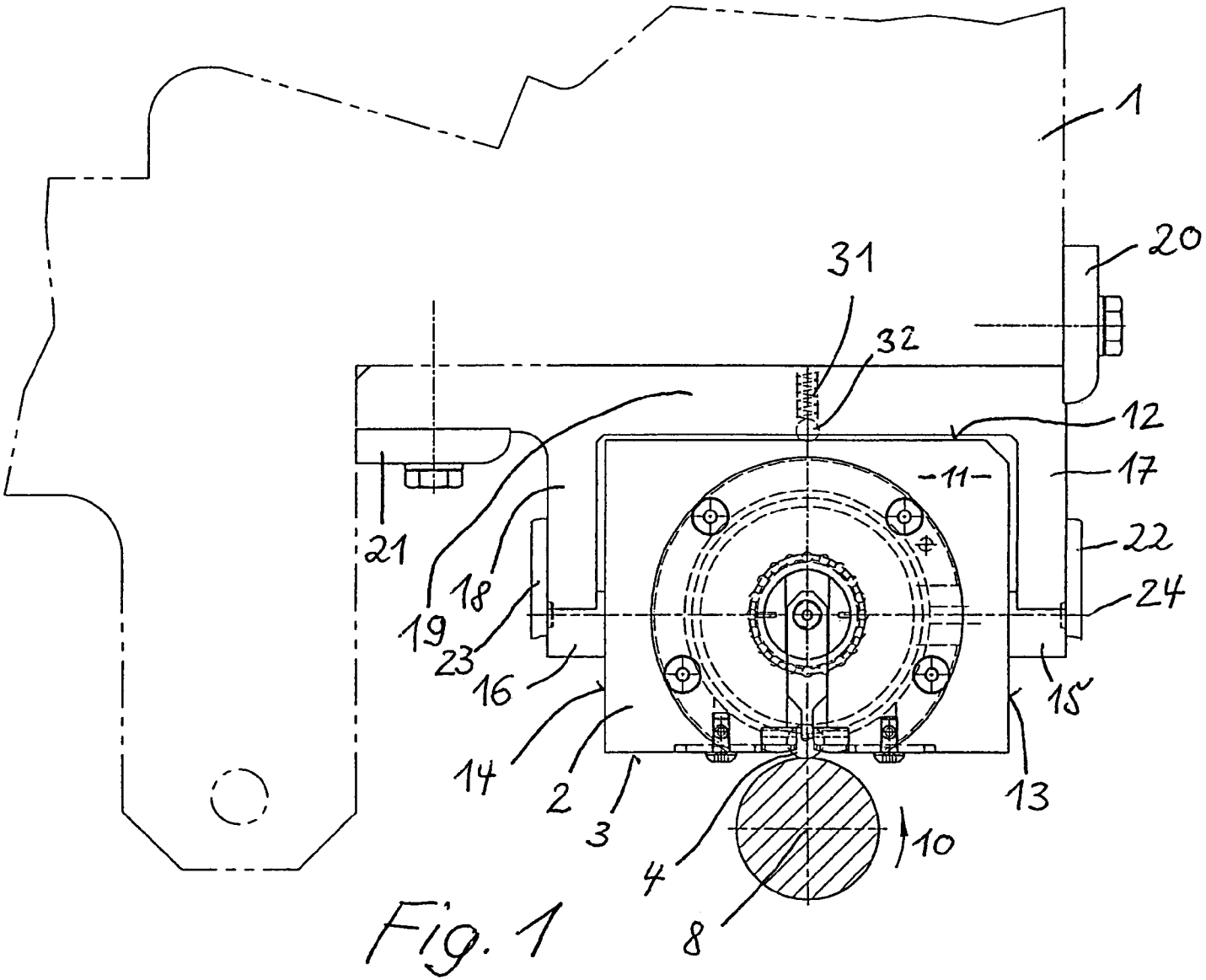

On a reduced scale and extensively simplified, the following drawings show:

FIG. 1 a side view and

Figure 2:
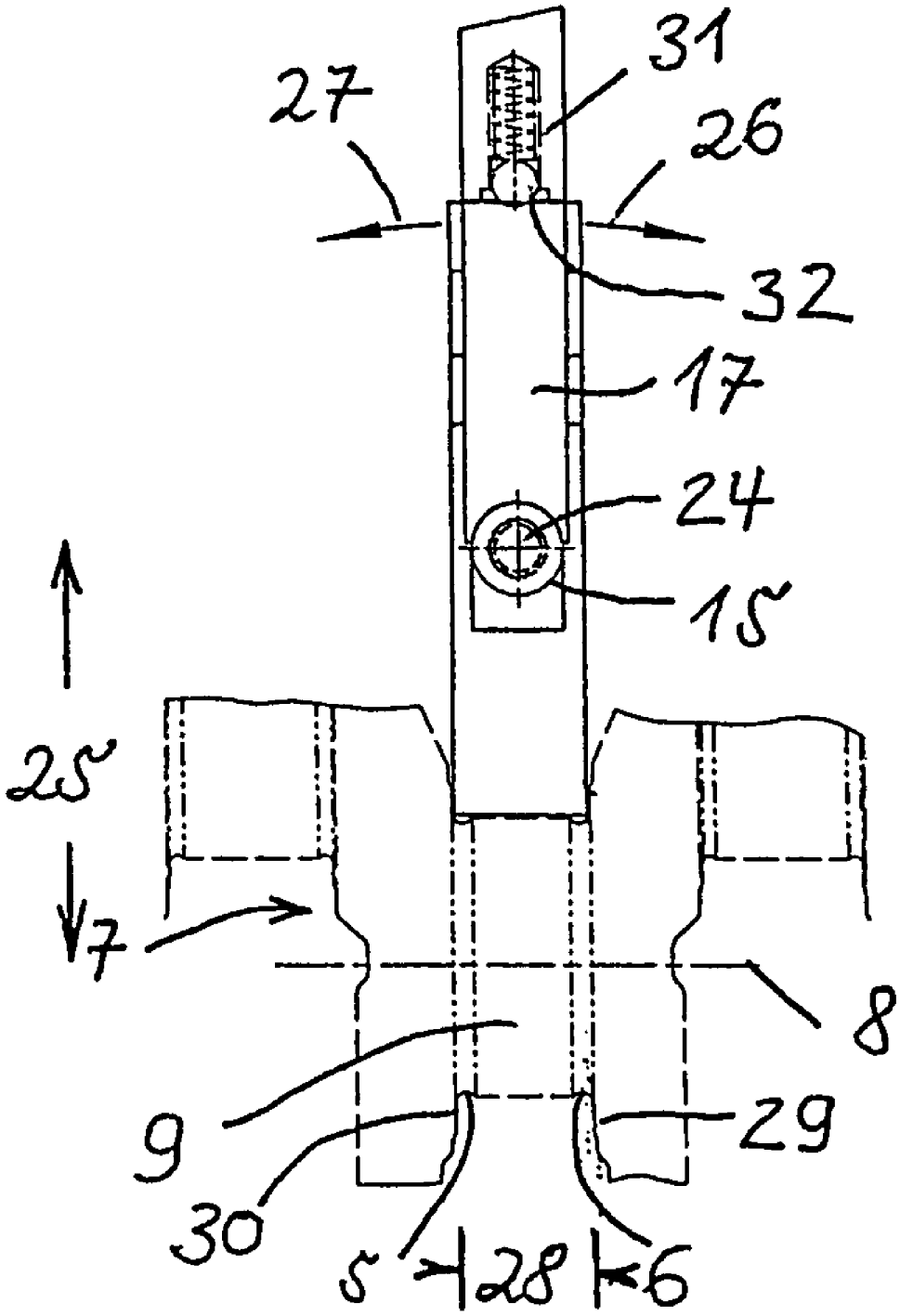

FIG. 2 a front view of the deep rolling head and its bearing.

DETAILED DESCRIPTION

On the outer end 1 of a shears arm of a deep rolling unit, there is mounted a deep rolling head 2. On the bottom side 3 of the deep rolling head 2, deep rollers 4 are rotatably supported with clearance. During the deep rolling process, the deep rollers 4 penetrate the fillets 5 and 6 of a crankshaft 7. The crankshaft 7 rotates upon its main axis of rotation 8 in a deep rolling machine (not shown), while it is driven by the machine. FIG. 1 shows a cross section through a main bearing pin 9 of the crankshaft 7. In FIG. 1, the main axis of rotation 8 of the crankshaft 7 runs vertically through the plane of the drawing. During the rotation of the crankshaft 7 in the direction of the arrow 10, the deep rollers 4 are driven by the rotation of the crankshaft 7 and rotate freely in the housing 11 of the deep rolling head 2.

The approximately rectangular housing 11 of the deep rolling head 2 has a bottom surface 3 and an upper surface 12, in addition to the two front end faces 13 and 14, which are both adjacent to the bottom surface 3 and the upper surface 12 respectively. From each of the front end faces 13 and 14 there projects a cylindrical member 15 and 16. The two members 15 and 16 are each supported such that they may pivot in projecting legs 17 and 18 of an F-shaped bracket 19, which is held on the outer end 1 of the shears arm by clamps 20 and 21.

For the holding of the deep rolling head 2 on the F-shaped bracket 19, two further brackets 22 and 23 are provided. The pivotable holding of the deep rolling head 2 by the members 15 and 16 on the projecting legs 17 and 18 allows the deep rolling head 2 to swivel around the pivot axis 24. The pivot axis 24 of the deep rolling head 2 has a given distance 25 from the axis of rotation 8 of the crankshaft 7, and the pivot axis 24 is simultaneously orthogonal to the axis of rotation 8 of the crankshaft 7. The pivotable support of the deep rolling head 2 enables it to swivel freely upon the axis of rotation 24. The swivel motion is indicated by the arrows 26 and 27. The otherwise free swiveling of the deep rolling head in the two directions 26 and 27 is limited by the distance 28 between the two oil collars 29 and 30 of the main bearing pin 9.

A rest 31, comprising a spring-loaded ball 32 that engages with the upper surface 12 of the housing 11, makes sure that the deep rolling head 2 always falls back into a middle position after a deflection in one of the two directions 26 and 27, as depicted in FIG. 2. The deflections in the two directions 26 and 27 are very small and generally only measure fractions of millimeters.

What is claimed:

1. A deep rolling head of a deep rolling tool of a shears-type deep rolling unit of a deep rolling machine used for the deep rolling of radii or fillets on the bearing pins of crankshafts comprising:

deep rollers that are rotatably supported in the deep rolling head with appropriate clearance;

the deep rolling head is mounted on the outer end of one of the two shears arms of the deep rolling unit;

the deep rolling head is pivotably attached to the end of one of the two shears arms; and cylindrical members projecting from the housing of the deep rolling head on each of the two front end faces that lie opposite each other and are adjacent to the bottom surface and the upper surface respectively, said cylindrical members are pivotably supported on the outer end of the shears arm.

2. The deep rolling head in accordance with claim 1, wherein the deep rolling head can pivot upon an axis that runs a given distance from and orthogonal to the axis of rotation of the crankshaft.

3. The deep rolling head in accordance with claim 1, further comprising an F-shaped bracket provided on the outer end of the shears arm for support of the deep rolling head, which is clampable to the shears arm and has two free legs on which the housing of the deep rolling head pivots.

4. The deep rolling head in accordance with claim 3, wherein a rest is provided between the F-shaped bracket of the shears arm and the housing of the deep rolling head to hold the housing in a centered position.

* * * * *